US007214949B2

(12) United States Patent
Schlitz

(10) Patent No.: US 7,214,949 B2
(45) Date of Patent: May 8, 2007

(54) ION GENERATION BY THE TEMPORAL CONTROL OF GASEOUS DIELECTRIC BREAKDOWN

(75) Inventor: Daniel Jon Schlitz, Lilburn, GA (US)

(73) Assignee: Thorrn Micro Technologies, Inc., Liburn, GA (US)

( * ) Notice: Subject to any disclaimer, the term of this patent is extended or adjusted under 35 U.S.C. 154(b) by 0 days.

(21) Appl. No.: 11/271,092

(22) Filed: Nov. 10, 2005

(65) Prior Publication Data

US 2006/0237662 A1 Oct. 26, 2006

Related U.S. Application Data

(60) Provisional application No. 60/627,261, filed on Nov. 12, 2004.

(51) Int. Cl.
*H01T 23/00* (2006.01)

(52) U.S. Cl. ..... 250/423 F; 361/231; 361/212; 361/230; 96/63

(58) Field of Classification Search ..... None
See application file for complete search history.

(56) References Cited

U.S. PATENT DOCUMENTS

| | | | | |
|---|---|---|---|---|
| 3,035,201 | A * | 5/1962 | Jackson et al. | 313/601 |
| 3,808,433 | A * | 4/1974 | Fite et al. | 250/251 |
| 4,038,583 | A | 7/1977 | Breton | |
| 4,185,316 | A | 1/1980 | Fleck | |
| 4,210,847 | A | 7/1980 | Shannon et al. | |
| 4,380,720 | A * | 4/1983 | Fleck | 315/111.91 |
| 4,559,467 | A | 12/1985 | Beckmann et al. | |
| 4,901,194 | A * | 2/1990 | Steinman et al. | 361/213 |
| 4,953,407 | A | 9/1990 | Malaczynski et al. | |
| 5,237,281 | A | 8/1993 | Webster et al. | |
| 5,434,469 | A | 7/1995 | Cirri | |
| 5,841,235 | A | 11/1998 | Engelko et al. | |
| 5,973,905 | A | 10/1999 | Shaw | |
| 5,977,716 | A | 11/1999 | Motouchi | |
| 6,061,074 | A | 5/2000 | Bartha et al. | |
| 6,074,518 | A * | 6/2000 | Imafuku et al. | 156/345.46 |
| 6,373,680 | B1 | 4/2002 | Riskin | |
| 6,659,172 | B1 | 12/2003 | Dewar et al. | |
| 6,703,785 | B2 | 3/2004 | Aiki et al. | |
| 2005/0007726 | A1 | 1/2005 | Schlitz et al. | |
| 2005/0121607 | A1 * | 6/2005 | Miller et al. | 250/287 |
| 2006/0011325 | A1 | 1/2006 | Schlitz | |

OTHER PUBLICATIONS

Ahn, et al., Fabrication and Experiment of a Plantar Micro Ion Drag Pump, Sensors and Actuators, pp. 1-5, (1998).

(Continued)

*Primary Examiner*—Nikita Wells
*Assistant Examiner*—Zia R. Hashmi
(74) *Attorney, Agent, or Firm*—Pillsbury Winthrop et al

(57) ABSTRACT

An apparatus and method for ion generation are adapted such that an ionization process is controlled temporally, to first initiate, then to halt the breakdown of the gas before a destructive plasma or glow is formed. This method controls the release of energy to the gas in such a manner as to create ions but prevent the heating of the gas. The primary advantages of this ion generation mechanism are its simplicity, efficiency and its ability to create ions at ambient temperature and pressure.

20 Claims, 6 Drawing Sheets

OTHER PUBLICATIONS

Belhadj, Ca et al., Corona Wind Velocity: Parametric Approach, IEE Conf. Ele. Insul. Dielec. Phenomena , pp. 489-492.
Bondar et al., Effect ofNuetral Fluid Velocity on Direct Conversion from Electrical to Fluid Kinetic Energy in an Electro-Fluid Dynamics Device, J. Phys. D. App. Phys., pp. 1657-1663, (1986).
Boulos, M., et al., Thermal Plasmas-Fundementals and Applications, Plenum Press (New York), (1994).
Colver, GM, et al., Modeling of DC Corona Discharge Along an Electrically Conductive Flat Plate with Gas Flow, IEEE Trans. on Indust. Apps., vol. 35 (No. 2), (Mar./Apr. 1999).
Franke, et al., Corona Wind Cooling of Horizontal Cylinders in Air, ASME/JSME Thermal Eng. Conf., pp. 261-267, (1995).
Fuhr, et al., Travelling Wave-Driven Microfabricated Electrohydrodynamic Pumps for Liquids, J. Micromech. Microeng., pp. 217-226, (1994).
Hirsch, Merele N., Gaseous Electronics, HJ Oskam Academic Press (New York), pp. 222-223, (1978).
Kalman, H., et al., Enhancement of Heat Transfer by Means of a Corona Wind Created by a Wire Electrode and Confined Wings Assembly, App. Therm. Eng., vol. 101 (No. 21), pp. 265-282, (2001).
Kucerovsky, et al., "Corona Wind in a System with the Pin-to-Plan Discharge Geometry," IEEE Ind. App. Soc 34th Ann. Meet., p. 14019.
Loeb, L., "Fundemental Processing of Electrical Discharges in Gases," Wiley & Sons (London), p. 514-521.
Nasser, E., "Fundementals of Gaseous Ionization and Plasma Electronics," Wiley Intersciences (New York), p. 296-311.
Ohadi, MM, et al., "Heat Transfer Enhancement ofLaminar and Turbulent Pipe Flow Via Corona Discharge," Int. J. Heat Mass. Transfer, vol. 34 (No. 4/5), p. 1175-1187.
Owsenek, J., et al., "Theoretical and Experiemental Study of Electrohydrodynamic Heat Transfer Enhancement Through Wire Plate Corona Discharge," Trans. of the AMS, p. 604-610.
Owsenek, et al., "Experimental Investigation of Corona Wind Heat Transfer Enhancement with a heated Horizontal Flat Plate," J. of Heat Transfer, p. 309-315.
Pickard, WM. F, "Ion Dray Pumping—I. Theory," J. App. Phys., vol. 34 (No. 2), p. 246-250.
Robinson, "Movement of Air in the Electric Wind of the Corona Discharge," Am. Inst. Elec. Eng. Comm. Electron. OIEE J., 1st ed., p. 143-150.
Schlitz, D., et al., "Microscale Ion-driven Air Flow Over a Flate Plate," Proc. Of NHTC: ASME 2004 Heat Transfer/Fluids Eng. Summer Conf, p. 1-6.
Schlitz, D., et al., "Numerical Simulation of Microscale Ion-Driven Air Flow," Proc. Of IMECE: ASME Int'l Mech. Eng. Congress, p. 1-8.
Shin, et al., "High-Temperature Electron Emission from Diamond Films," J. Vac. Sci, vol. B21 (No. 1), p. 587-592.
Singhal, V., et al., "Influence of Bulk Fluid Velocity on the Efficiency of Electrohydrodynamic Pumping," a white paper, p. 1-39.
Sobhan, et al., "A Comparative Analysis of Studies on Heat Transfer and Fluid Flow in Microchannel," Microscale Thermophys Eng., p. 293-311.
Stuetzer, O., et al., "Ion Drag Pumps," J. Appl. Phys., p. 136-146.
Stuetzer, O., et al., "Ion Drag Pressure Generation," J. App. Phys., vol. 30 (No. 7), p. 984-994.
Tuckerman, et al., "High Performance Heat Sinking for VLSI," IEEE Elect. Device. Lett., vol. EDL (No. 5), p. 126-129.
Wong, et al., "Development of a Micropump for Microelectronic Cooling," MEMS ASME, p. 239-244.
Yang, F., et al., "Corona Driven Air Propulsion for Cooling of Electronics," XIIIth Int'l Symp. On High Volt.. Eng., p. 1-4.
Zhao, L., et al., "EHD Flow in Air Produced by Electric Coronoa Discharge in Pin-Plate Configuration," J. of Electrostatics, p. 337-350.

* cited by examiner

FIGURE 4A
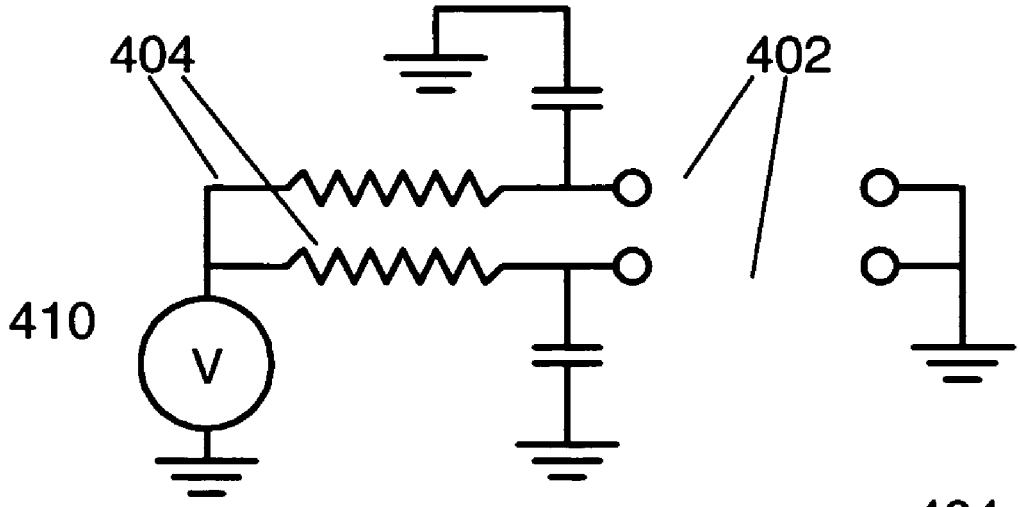
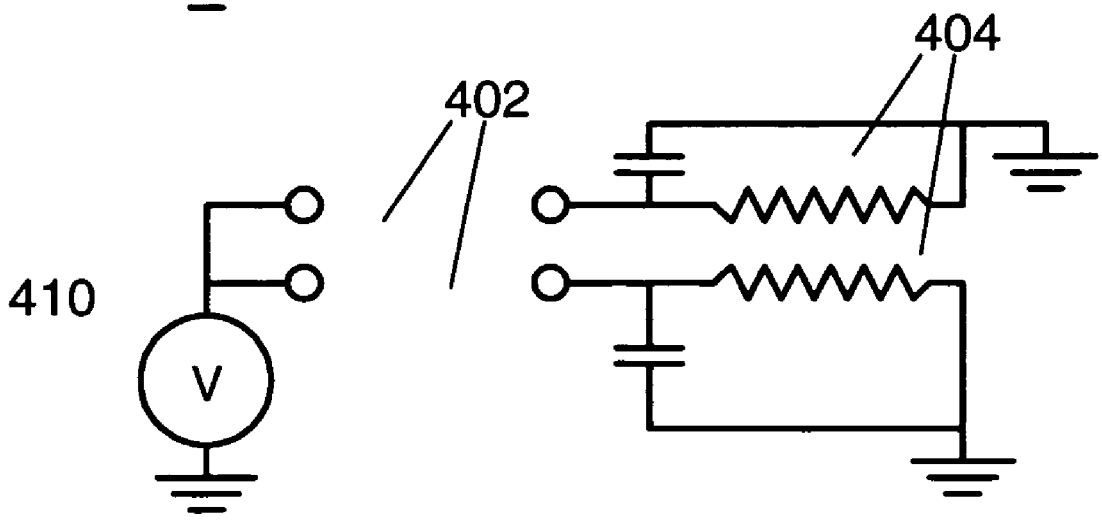
FIGURE 4B

ION GENERATION BY THE TEMPORAL CONTROL OF GASEOUS DIELECTRIC BREAKDOWN

CROSS-REFERENCE TO RELATED APPLICATIONS

The present application is based on, and claims priority from, U.S. Provisional Appln. No. 60/627,261, filed Nov. 12, 2004, the contents of which are fully incorporated herein by reference.

FIELD OF THE INVENTION

The present invention relates to a method for producing ions and free electrons in a gas with an electric current pulse, and more particularly to a method that controls the release of energy to the gas in such a manner as to create ions and free electrons but prevent heating of the gas.

BACKGROUND OF THE INVENTION

Ion generation is used in a wide variety of applications including, for example, ion implantation, thin film formation, etching and sputtering operations, propulsion in space ships, electrostatographic devices, electro-static air cleaners, for the generation of negative ions for medicinal purposes and electro-hydrodynamic gas pumps.

As is understood in the field of ion generation, a gas such as air can be thought of as a non-linear circuit element. At temperatures below 1000° C. and electric fields below the dielectric breakdown point, gasses are insulating and free of ions (M. Boulos, P. Fauchais and E. Pfender, *Thermal Plasmas—Fundamentals and Applications,* Plenum Press, New York, 1994). Under these conditions, no current will flow between a pair of electrodes separated by a gas gap. However, there is a point where the potential difference between two electrodes can be high enough to cause the gas to breakdown and transition from an electrical insulator to a conductor.

FIG. 1 illustrates one method of ion generation. The process begins with a small number of seed electrons that are free to pass through the gas. These free electrons can be released from the gas by random photo-ionization or collision-ionization. The electrons can also be emitted from the cathode electrode by processes collectively referred to as secondary electron emission (L. Loeb, *Fundamental Processes of Electrical Discharge in Gases,* Wiley & Sons, London, 1947). These cathode processes include ion bombardment, photo-ionization and other processes. In the presence of a high electric field, the free electrons interact with the neutral gas molecules to create ions and additional electrons. An avalanching chain reaction takes place and the number of electrons and ions in the gas increases rapidly over time (shown in the drawing as proceeding left to right). As a result of this chain reaction, very quickly (0.05 to 10 μs), the gas evolves into a high-temperature plasma or glow, which is a state where a significant number of molecules are ionized and a large amount of free electrons are present (E. Nasser, *Fundamentals Of Gaseous Ionization And Plasma Electronics,* Wiley-Interscience, New York, 1971). In this state the gas is at a high temperature and is highly conductive. Gas in this state is fundamentally different from an insulating state.

The various conventional approaches to ion generation according to the prior art can be gleaned from certain issued U.S. patents For example, in U.S. Pat. No. 6,373,680, entitled "Method and device for ion generation," a time varying corona discharge is used to generate ions. The time varying corona discharge is created in air by relatively slow voltage pulses between corona electrodes. During the pulse, a corona discharge is established. The pulse duration is short enough such that ions generated in the corona do not have time to reach a neutralizing electrode before the pulse is turned off. With the electric field turned off, the ions are exhausted to the ambient air by a fan. Although the voltage is pulsed, the frequency is low and the corona discharge is fully developed during each pulse. The field is turned off after the gas region fills with ions. The field is removed mainly to aid in the ejection of ions into the ambient air.

Another example is U.S. Pat. No. 5,841,235 entitled "Source for the generation of large area pulsed ion and electron beams." This patent describes a vacuum arc plasma source where the discharge current is controlled by a parallel circuit including an ohmic resistor and a capacitor. The difference with this prior art is that the discharge created is a plasma type discharge. Ions are not created at ambient temperature, but at a high temperature.

Several other patents relate to various aspects of ion generation using a corona discharge. Generally, these approaches generate ions under steady-state or near steady-state conditions. This group of patents relies on the partial breakdown of air that is found with a sharp-blunt electrode pair at high voltages. These patents include U.S. Pat. No. 6,703,785 entitled "Negative ion generator," U.S. Pat. No. 5,977,716 entitled "Ion generator for a combustion device," U.S. Pat. No. 4,559,467 entitled "Ion-generator for producing an air flow," U.S. Pat. No. 6,061,074 entitled "Ion generator for ionographic print heads," U.S. Pat. No. 5,973,905 entitled "Negative air ion generator with selectable frequencies," U.S. Pat. No. 4,185,316 entitled "Apparatus for the generation of ions," U.S. Pat. No. 4,038,583 entitled "Apparatus for the generation of negative or positive atmospheric ions."

U.S. Patent Publication No. 2005/0007726 A1 describes a unique ion generating process. This invention uses electrons emitted from a nano-featured cathode by a quantum tunneling process. The electrons are then reacted with the gas to create unipolar ions without inducing an avalanche. The avalanche is avoided by placing electrodes only a few microns apart —too short of a distance to develop the chain reaction shown in FIG. 1. The disadvantages of this approach include a sensitivity of the nano-featured cathode emitter to contamination and damage, and an inability to produce a large enough number of ions.

Another example of the shortcomings of the prior art is U.S. Pat. No. 5,434,469 entitled "Ion generator with ionization chamber constructed from or coated with material with a high coefficient of secondary emission." This ion generator is for ion beam equipment and attempts to improve ion generation efficiency by increasing the secondary electron emission coefficient of the chamber walls in a plasma ion generator. This prior art describes a second alternative for ion generation where high temperature ions are formed in a high temperature plasma.

These and other prior art approaches have many shortcomings. Individually and collectively, these include requiring high voltage, high amounts of input energy and operating at high temperatures and pressures for ion generation. Electrodes are exposed to the hostile environment of a high-temperature plasma and suffer from degradation effects. Ions generated by the prior art are not suited for various applications such as cooling systems because, for example, introducing ions at a high temperature would limit or eliminate the heat removal ability of such a system.

Accordingly, there exists a need in the art for an improved ion generation technique over corona discharge that is well suited for various applications such as cooling systems, along with the ability to operate in ambient conditions of temperature and pressure, and without the need for special electrodes.

SUMMARY OF THE INVENTION

The present invention relates to a method and apparatus for ion generation wherein an ionization process is controlled temporally so as to halt the breakdown of the gas and prevent the formation of a destructive plasma or glow. According to one aspect, the present invention recognizes the time evolution of gaseous dielectric breakdown to create ions at near ambient conditions. Dielectric breakdown is initiated by exposing the gas to an electric field that exceeds its breakdown strength. Avalanches of electrons sweep across the gas, creating ions. After a short time, the electric field is reduced below the breakdown strength, stopping the electron avalanches and the breakdown process and preventing the gas from becoming a glow or plasma. The gas is now filled with ions at near ambient conditions. The ions are directed by a secondary electric field or by other means to be used for any of the aforementioned purposes. Some of many advantages of this ion generation mechanism are its simplicity and its ability to create ions with a relatively small voltage at ambient temperature and pressure.

BRIEF DESCRIPTION OF THE DRAWINGS

These and other aspects and features of the invention will be understood by the following detailed descriptions in conjunction with the drawings, wherein:

FIGS. 4A and 4B are schematic diagrams of two preferred embodiments for creating multiple ionization zones in accordance with the invention;

DETAILED DESCRIPTION OF THE PREFERRED EMBODIMENTS

Figure 1:
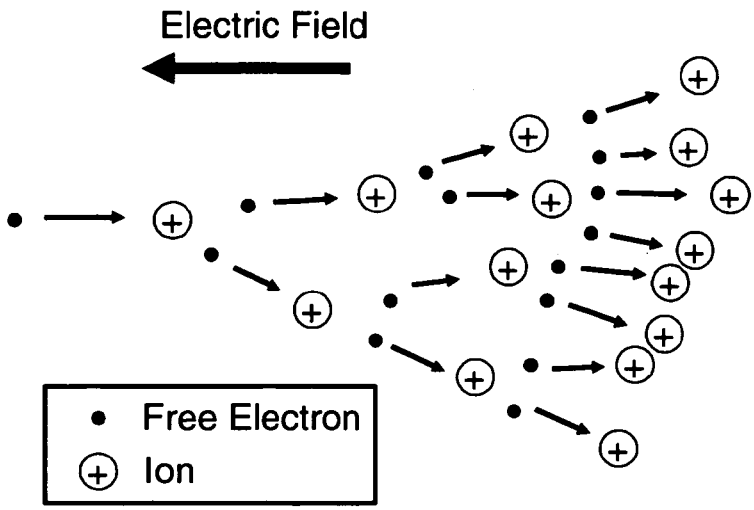
FIGURE 1 (Prior Art)
FIG. 1 shows the chain reaction process of the electron avalanche according to known principles.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather the invention can be extended to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

An aspect of the invention, not disclosed or suggested by the prior art such as that discussed above, is to generate ions in a gas by first beginning the process of full-scale dielectric breakdown and then quickly stopping the process before a high temperature glow or plasma is formed. Halting the flow of electric power in this manner minimizes the energy released into the gas. This controlled release of energy generates gaseous ions in an efficient manner so as not to cause general heating of the gas. Thus, an advantage of the current invention is that ions are created with a minimal amount of input energy and at room temperature and pressure. Additionally, the electrodes are not exposed to the hostile environment of a high temperature plasma and do not suffer from degradation effects.

An advantage of this invention over corona discharge, beside the ambient temperature ion generation, is the elimination of the need for a sharp-blunt electrode pair. All prior art inventions have constraints on the electrode geometry. Although this invention can utilize a sharp-blunt electrode system, it is not a requirement. Electrode geometry can instead be designed to maximize other parameters (like gas flow rate) rather than ion generation.

One advantage of the present invention over the nano-featured cathode emitter is that in the present invention, one seed electron can be used to create millions or billions of ions through a chain reaction process. In the nano-featured cathode emitter, due to the requirement of closely spaced electrodes, each emitted electron produces only about one ion. Additionally, the source of the seed electrons in the present invention can be from a variety of sources, such as; photo-ionization of the gas or cathode, or ion bombardment of the cathode. The nano-featured cathode emitter, however, relies exclusively on creating intense electric fields at sharp tips to tunnel electrons out of the cathode and into the air. These nano-tips are very prone to damage and contamination.

Figure 2A:
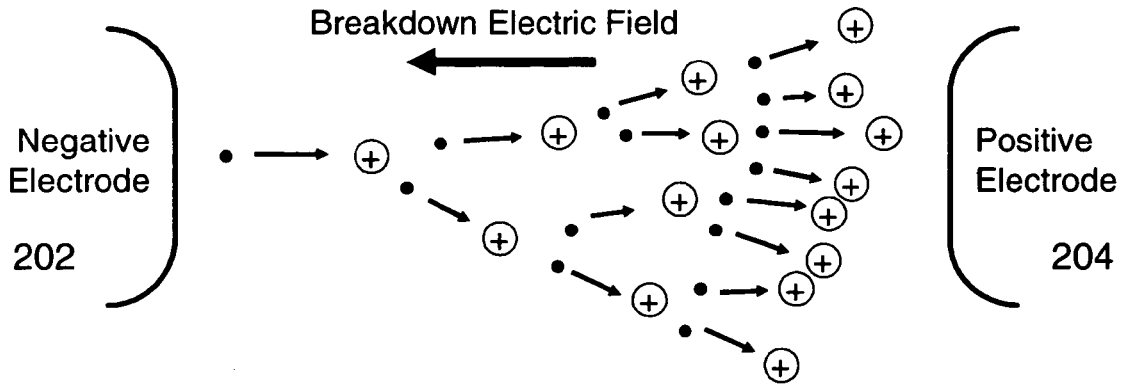
FIGS. 2A and 2B illustrate the temporal development of ions and their subsequent deployment in accordance with one embodiment of the invention.

An exemplary method of creating a short duration electric field in a gas in accordance with the principles of the invention will be described herein. As shown in FIG. 2A, a pair of electrodes 202, 204 are disposed on either side of the gas to be ionized. The potential difference between the electrodes 202, 204 is regularly pulsed to generate an electric field that alternates in strength between exceeding and not exceeding the dielectric strength of the gas. Breakdown is initiated when the high electric field is present and ions are created.

Figure 2B:
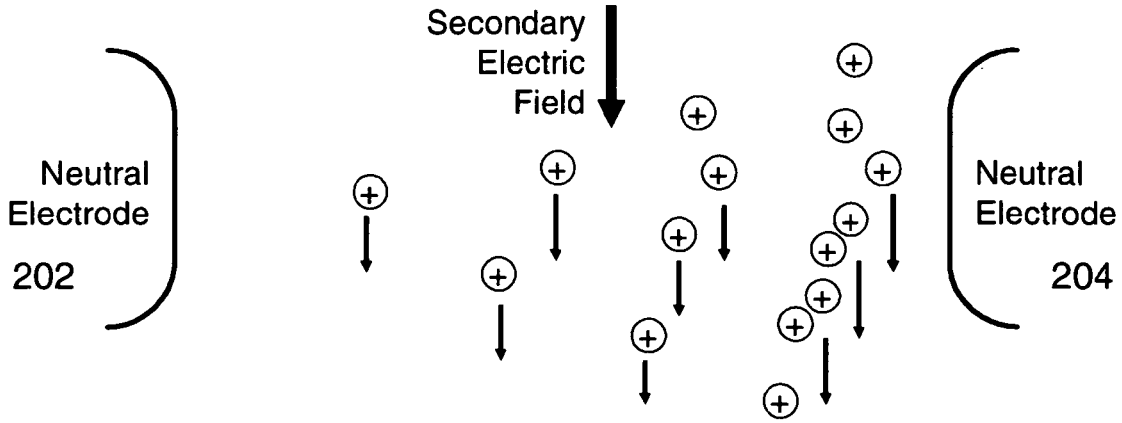

At a time between pulses when the electric field between electrodes 202, 204 is low (i.e. the electrodes are neutral), the ions are moved by secondary fields for use in the final application, as illustrated in FIG. 2B. The secondary field can be generated by a variety of methods. Different preferred embodiments are discussed in more detail below.

Pulsing Electrode Circuit

Figure 3A:
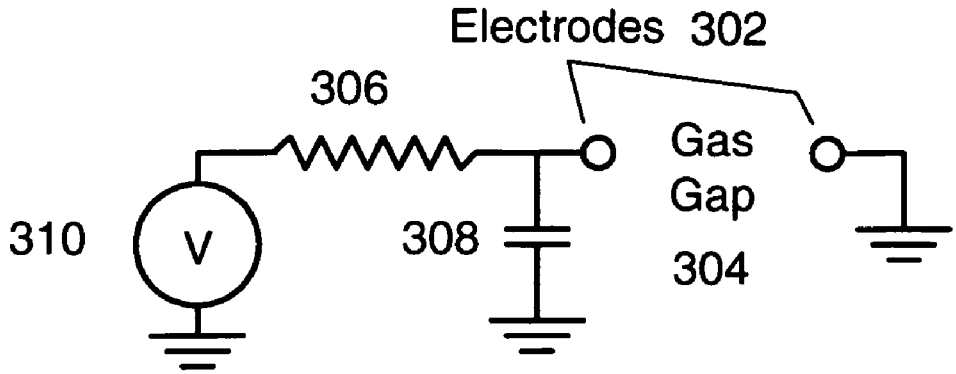
FIGS. 3A and 3B are schematic diagrams of two preferred embodiments for an ion generation circuit in accordance with the invention.
Figure 3B:
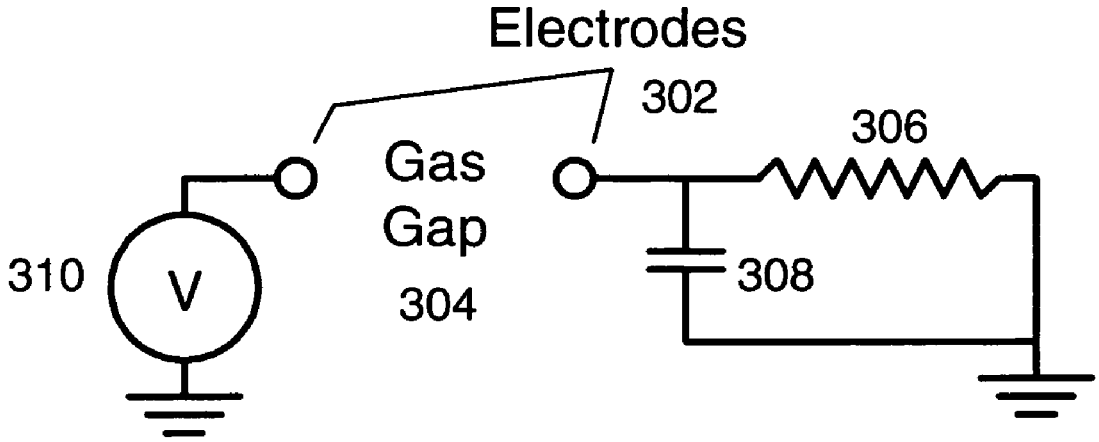

Two example embodiments of a very simple and inexpensive circuit to create a pulsing voltage in accordance with the invention are shown in FIGS. 3A and 3B. As shown in FIGS. 3A and 3B, the circuits both include a pair of electrodes 302 separated by a gas gap 304 (e.g. atmospheric air). Generally, the circuits take advantage of the non-linear behavior of the gas gap to generate the pulsing action. As can be seen, the two embodiments respectively shown in FIGS. 3A and 3B differ in the orientation of the RC pair with respect to the voltage source 310 and gas gap 304.

The circuits are powered by a voltage source 310. Once breakdown is initiated in circuit 300A, the capacitor 308 in FIG. 3A discharges across the gap 304. This creates an avalanche of electrons that sweep across the gap. Due to the avalanche effect across the gap, millions or billions of ions can be formed during this time. As the capacitor discharges, the electric field across the gap is diminished to the point where further avalanches are prevented. The ions in the gap are then moved to their application. The embodiment in FIG. 3B operates on a similar principle except that the controlling capacitor 308 charges up, rather than discharges, during the ion formation period. As the resistor 306 charges up the capacitor 308 (FIG. 3A), or bleeds the charge off of the capacitor 308 (FIG. 3B), the electric field across the gap increases until breakdown occurs again and the process repeats.

As should be apparent to those skilled in the art, the values of the resistor (R) 306 and the capacitor (C) 308 need to be adjusted to the particular application to prevent plasma formation and to maximize important parameters such as ion generation efficiency, as will be explained in more detail below.

First, the value of C determines the amount of charge that passes through the gap per pulse and the duration of the pulse (i.e. the temporal control of the ionization process). In accordance with the invention, therefore, it is preferable that the value of C be low enough such that current does not flow through the gap for too long a period and cause a glow or plasma to form. Meanwhile, the value of R×C, along with other factors such as the type and magnitude of the voltage source 310, electrode 302 geometry and spacing, determines the pulsing frequency. These interrelated factors can be quantitatively determined for a given application by those skilled in the art without undue experimentation.

For example, in microscale air gap applications (i.e. under ambient conditions of temperature and pressure, and where the separation between electrodes 302 is about 100 μm and the voltage source 310 is about 1000 V (DC or AC), typical values of R range between 10 to 10,000 MΩ and values of C range from 0.1 to 100 pF.

An advantage of these values is that they lend themselves well to conventional micro-fabrication techniques. For example, the resistor can be embodied by a thin layer of a material conventionally thought of as an insulator ($SiO_2$, $Al_2O_3$, etc.). These materials are normally insulating, but when very thin they can have a desirable high resistance. Similarly, the low capacitance capacitor can be constructed or integrated within a micro-scale device by simply using the inherent capacitance of the electrodes.

As discussed above, in addition to voltage and R×C values, the size, shape and separation of the electrodes 302 can further affect the pulsing frequency. Moreover, these factors can also determine the "turn on" voltage (the voltage at which ionization begins), the amount of ions formed and can also be used to direct the ions to their application. In a microscale air gap application having the R and C values described for above for example, and without limiting the present invention, extremely sharp electrodes, with tip radii in the range of 1 to 50 nm, such as nano-wires or carbon nanotubes, can begin ionizing gases near the theoretical minimum potential of 10 to 15 Volts and are preferred. These extremely sharp electrodes can be employed as sharp-sharp or sharp-blunt electrode pairs.

An example of the present invention is a system that contains a 100 MΩ resistor and 3 pF capacitor in a circuit similar to FIG. 3A. The electrodes are 1 mm diameter wires separated by 50 μm of air. With a DC voltage ranging from 1000 to 2000 Volts, a pulse of current about 1 μs in duration flows across the gap. The repetition frequency ranges from 1 kHz and 20 kHz. Under these conditions, ions are being created in the gap at ambient temperature and pressure with each current pulse, but the temporally controlled process prevents plasma formation. The repetition frequency can be increased by decreasing both the capacitance and resistance.

It should be apparent that many variations and alternatives of the examples of the invention discussed in connection with FIGS. 3A and 3B are possible. For example, as shown in FIGS. 4A and 4B, multiple zones 402 of ionization can be created using a single voltage source 410, such as by using multiple capacitor/resistor networks 404 in parallel. Placing the capacitor/resistor networks in parallel ensures current sharing between different zones. It should be noted that although only two zones 402 are shown in the figures, that the principles can be extended to an indefinite number of zones. Moreover, other arrangements for providing multiple zones other than a parallel arrangement are possible.

Electro-hydrodynamic Gas Pumping

Ions generated by the methods and apparatuses of the present invention are suited for existing applications such as ion implantation, thin film formation, etching and sputtering operations, propulsion in space ships, electrostatographic devices, electro-static air cleaners and for the generation of negative ions for medicinal purposes. However, the invention extends the usefulness of ion generation to a wider variety of applications, such as new use in an electro-hydrodynamic (EHD) pump for cooling systems. Although it is known that ions can be used to impart momentum to a gas so as to create a "wind," conventional EHD approaches cannot be readily applied to drive a gas through a heat sink to remove heat. For example, the conventional approaches require introducing ions at a high temperature, which limits or completely eliminates the heat removal ability of such a system.

One example application of the invention in an electro-hydrodynamic (EHD) gas pump will now be described in conjunction with FIGS. 5A and 5B. In general, these figures show a three electrode system that generates ions in the manner already discussed in connection with FIGS. 3A and 3B and utilizes the generated ions to pump a gas. The underlying principle for both circuits is the same. Initially, a strong electric field exists in the gap 506 between the two ion generating electrodes 502 and the gas begins to breakdown and form ions in that region. During the process of ion generation the generating electrodes 502 acquire similar potentials. A third electrode 504 is held at a potential which is different from the ion generating electrodes after generating ions. The presence of this electrode 504 near the gap 506 creates a secondary field which attracts the ions. The ion motion creates a pumping action that imparts a momentum that moves the gas. For example, in FIG. 5A, the generation electrodes 502 become charged after ionization (+ or −) and push the ions towards the grounded third electrode 504. In FIG. 5B, the generation electrodes 502 become grounded after ionization and are attracted to the charged (+ or −) third electrode, thus creating a gas flow that can be used to remove heat in a heat sink. Both circuits are shown with an optional current limiting resistor on the third electrode to prevent plasma formation in some situations.

Figure 6A:
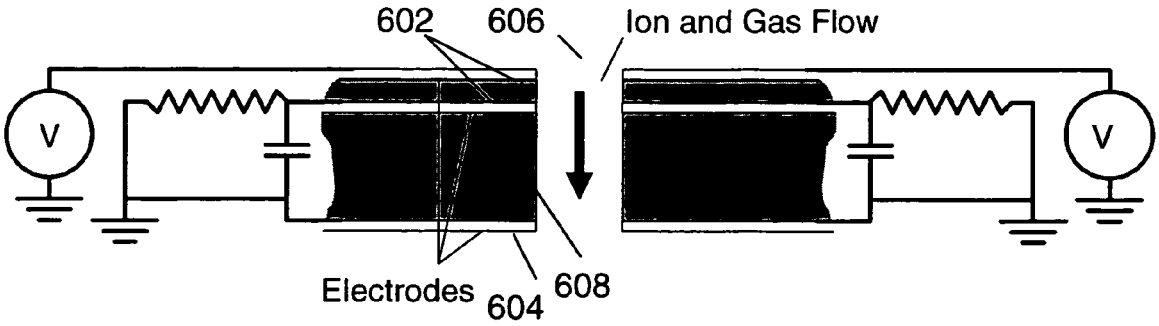
FIGS. 6A and 6B illustrate example implementations of preferred embodiments of the three electrode scheme in accordance with the invention.
Figure 6B:
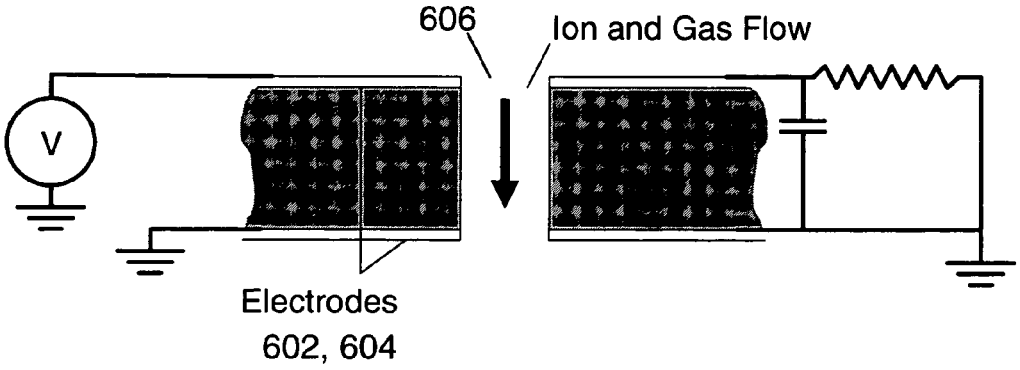

Two example structures for a three-electrode EHD pumping scheme are shown in FIGS. 6A and 6B. The ion generating electrodes 602 are located at or near a channel 606 inlet. The channel 606 is part of an EHD heat sink in which gas (e.g. air) flowing through the channel is used to cool a heat source (not shown) that is thermally coupled to the channel. The third electrode 604 is located further downstream, separated by about 1 mm from the electrodes 602. The ion generating electrodes can be stacked vertically or separated horizontally either across the channel 606 (FIG. 6B) or on the same channel wall 608 (FIG. 6A). In any case, the ions are generated near the channel inlet and are pushed downstream through the channel (with the gas) towards the "third" electrode.

Figure 7:
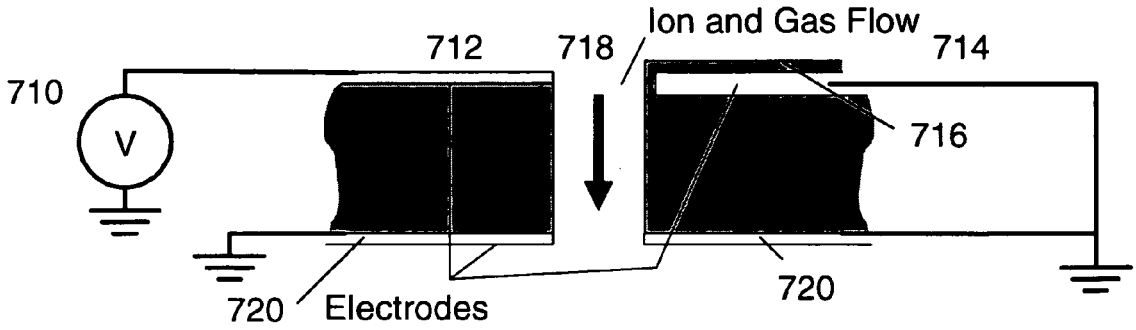
FIG. 7 shows an example implementation of the embodiment of the invention shown in FIG. 5.

Further example details of how various embodiments of the invention can be realized in an actual application will now be explained in connection with FIG. 7. In the example implementation of FIG. 7, one electrode 714 is aluminum having a thickness of about 500 nm and is covered by a thin dielectric 716 of, for example, polyimide having a thickness of about 1 μm. Voltage source 710 is 1000 VDC which causes the gas gap between electrodes 712, 714 to begin to break down. The process is halted as charge accumulates on the surface of the dielectric 716 covering the electrode 714. Thus the dielectric coating acts as a capacitor. However, the thin dielectric 716 allows charge to slowly leak off of the surface and to the electrode. Thus the dielectric coating also acts as a resistor and allows charge to leak through and discharge the capacitor. Therefore, the system shown in FIG. 7 is equivalent to the circuit diagramed in FIG. 5A. Ions are formed at the channel inlet 718 and are drawn by a secondary field established by the "third" electrode 720, which is held to a ground potential.

Figure 5A:
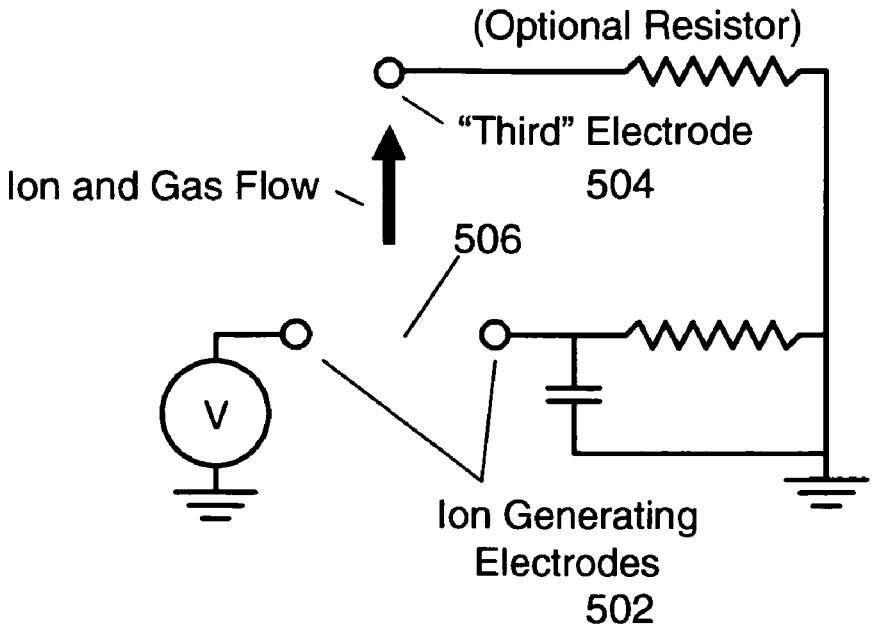
FIGS. 5A and 5B are schematic diagrams of preferred three-electrode schemes that generate ions and use them to create gas flow in accordance with additional aspects of the invention.
Figure 5B:
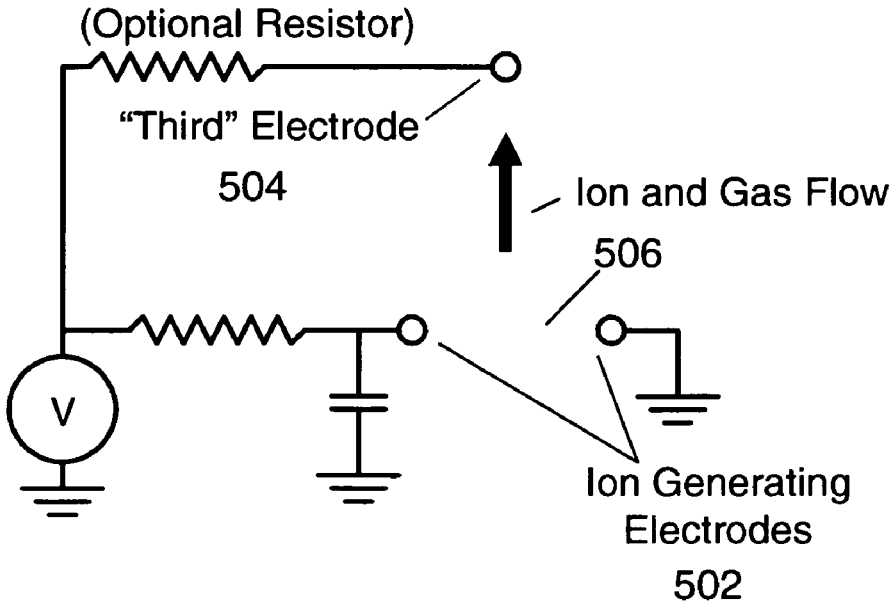
Figure 8:
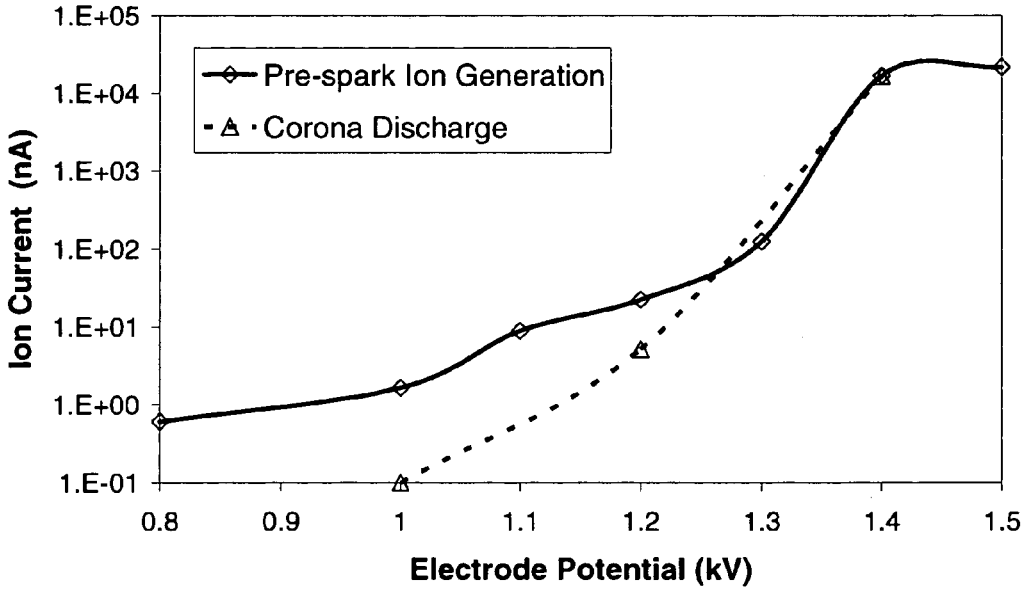
FIG. 8 is a chart illustrating a comparison of present invention and corona discharge ion generation mechanisms.

A three electrode design such as that depicted in FIG. 5A was tested to demonstrate the feasibility of producing ions by means of temporal control of gaseous dielectric breakdown. FIG. 8 plots the ion current as a function of electrode potential for the present invention and for corona discharge. The present invention is seen to "turn on" at a lower voltage and sustain a higher ion current than the corona discharge (note that the ion current scale is logarithmic).

Although the present invention has been particularly described with reference to the preferred embodiments thereof, it should be readily apparent to those of ordinary skill in the art that changes and modifications in the form and details may be made without departing from the spirit and scope of the invention. Certain aspects of one embodiment may also be interchanged with the other embodiments. It is intended that the appended claims encompass such changes, modifications and interchanges.

What is claimed is:

1. A method of generating ions in a gas, comprising:

temporally controlling an electric field applied to the gas, including increasing the electric field so as to create ions in the gas during a plurality of first time periods, and lowering the electric field in a plurality of second time periods respectively following the first time periods, thereby preventing the formation of a plasma, corona or glow in the gas during the first and second time periods; and maintaining the temporally controlling step so as to create a sustained flow of the gas due to the generation of ions oyer the elapsed first and second time periods.

2. A method of generating ions, comprising:

exposing a gas to an electric field that exceeds a breakdown strength corresponding to the gas;

permitting avalanches of electrons to sweep across the exposed gas so as to create ions;

reducing the electric field below the breakdown strength, thereby stopping the electron avalanches and the breakdown process and preventing the gas from becoming a glow, corona or plasma; and repeating the exposing, permitting and reducing steps so as to create a sustained flow of the gas due to the repeated creation of ions.

3. A method according to claim 2, further comprising:

repeating the exposing, permitting and reducing steps in accordance with a pulsing frequency.

4. A method according to claim 2, further comprising:

providing a secondary electric field that causes the created ions and the gas to move in a desired direction during the reducing step.

5. A method according to claim 4, wherein the desired direction is through a channel of a heat sink.

6. An apparatus for creating ions, comprising:

a pair of electrodes separated by a gas gap;

a voltage source coupled to the electrodes; and a resistor and capacitor coupled to the electrodes, wherein the resistor and capacitor temuorally control an amount of charge the voltage source provides to the electrodes so as to create short pulses of current across the gas gap, the short pulses of current generating ions.

7. An apparatus according to claim 6, wherein as the capacitor charges and discharges, the electric field across the gap increases and decreases past and below breakdown, respectively, thereby causing the ion generation process to repeat.

8. An apparatus according to claim 6, wherein the pulses are temporally controlled to prevent the formation of a destructive plasma or glow in the gas.

9. An apparatus according to claim 6, wherein the short pulses repeat at a radio frequency (RF) rate.

10. An apparatus according to claim 6, further comprising a third electrode that is coupled to a potential so as to attract the generated ions.

11. An apparatus according to claim 10, wherein the third electrode is disposed downstream from the gas gap so that the attracted ions cause the gas to flow across a heat source.

12. An apparatus according to claim 11, wherein the gas flows through a channel coupled to the heat source.

13. An apparatus according to claim 6, wherein the resistor and capacitor are constituted by a thin dielectric covering on one of the electrodes.

14. An apparatus according to claim 6, wherein the electrodes are comprised of sharp electrodes with tip radii between 1 and 50 nm.

15. An apparatus according to claim 14, wherein the electrodes are separated by about 100 μm.

16. An apparatus according to claim 6, wherein the voltage source is a direct current (DC) voltage source.

17. An apparatus according to claim 6, wherein the resistor and capacitor define a time constant corresponding to a duration of the short pulses.

18. An apparatus according to claim 17, wherein the voltage source is a direct current (DC) voltage source and the resistor and capacitor further define a repetition frequency of the short pulses.

19. An apparatus according to claim 6, wherein the voltage source is an alternating current (AC) voltage source that alternates at a first frequency, and wherein the resistor and capacitor define a repetition frequency of the short pulses that is substantially higher than the first frequency.

20. An apparatus according to claim 18, wherein the repetition frequency is between approximately 1 kHz and 20 kHz.

* * * * *